United States Patent [19]

Cavanaugh et al.

[11] Patent Number: 4,690,308

[45] Date of Patent: Sep. 1, 1987

[54] PAIL MOUNT PUMP WITH INTEGRAL COVER

[75] Inventors: James E. Cavanaugh, Sunland; Larry Erwin, North Hollywood; Robert D. Hetherington, Sunland, all of Calif.

[73] Assignee: Binks Manufacturing Company, Franklin Park, Ill.

[21] Appl. No.: 817,527

[22] Filed: Jan. 9, 1986

[51] Int. Cl.[4] ..... B67D 5/52

[52] U.S. Cl. ..... 222/156; 222/255; 222/318; 222/383; 239/127

[58] Field of Search ..... 366/159; 248/678; 222/135, 156–157, 249, 255, 265, 271, 275, 318, 334, 372, 382–383, 405, 478–482, 556; 417/397; 239/127, 302–305

[56] References Cited

U.S. PATENT DOCUMENTS

| | | | |
|---|---|---|---|
| 1,467,951 | 9/1923 | Rosenberger | 222/156 X |
| 2,943,765 | 7/1960 | Glasgow et al. | 222/383 X |
| 2,959,358 | 11/1960 | Vork | 222/334 X |
| 3,006,505 | 10/1961 | Levin | 222/235 X |
| 3,216,627 | 11/1965 | Best et al. | 222/249 |
| 3,727,807 | 4/1973 | Flider | 222/469 |
| 3,765,605 | 10/1973 | Gusmer et al. | 239/61 |
| 4,126,399 | 11/1978 | Schneider et al. | 366/159 |
| 4,278,132 | 7/1981 | Hostetter | 169/13 |
| 4,350,266 | 9/1982 | Hetherington et al. | 222/40 |
| 4,470,316 | 9/1984 | Jiskoot | 222/249 X |
| 4,516,725 | 5/1985 | Cavanaugh et al. | 239/127 |
| 4,577,828 | 3/1986 | Drucker et al. | 248/678 |
| 4,588,110 | 5/1986 | Nelson et al. | 222/135 |

*Primary Examiner*—Joseph J. Rolla
*Assistant Examiner*—Michael S. Huppert
*Attorney, Agent, or Firm*—David O'Reilly

[57] ABSTRACT

A pail mounted pump system having dual reciprocal pumps and pail cover in an integral design. The pump and pail cover are constructed in a single unit with a built-in intake siphon tubes. This arrangement provides dual pumps pumping the same fluid which keeps the system pumping should one of the pumps fail. The pail cover is formed with a recess and mounting holes for mounting a pump. A skirt on the cover has a flange on its inner surface forming an annulus which seats securely on the pail rim. A recirculation/agitation system is provided by a hose connected through a valve to the pump outlet recirculating fluid back to the pail through an aperture in the cover.

8 Claims, 5 Drawing Figures

PAIL MOUNT PUMP WITH INTEGRAL COVER

FIELD OF THE INVENTION

This invention relates to pumps and more particularly relates to a low profile integrally formed pump and pail cover.

BACKGROUND OF THE INVENTION

Often, for portability, pumps are mounted directly on paint containers or pails. It simplifies and eliminates the need for transferring the paint or other liquid from the pail to another container. Such procedures are generally messy and time consuming and are unnecessary where there are relatively small jobs involved.

To solve these problems pumps have been mounted directly on the pail for delivering the fluid from the pail to the job site. The usual procedure is simply to have a lid, very similar to the normal flat lid pressed on the pail, with the pump simply bolted to the lid with its intake tube immersed in the fluid. A problem with such an arrangement is that the pump is heavy and has a high center of gravity making the combination of pump and pail unwieldy and as well as unstable. A further problem is that pump failure completely shuts down the system. Often in trying to move the pump and pail the system can easily be tipped over causing spillage as well as damage to the pump. It would be advantageous if the pump and pail cover arrangement could be made to be compact, stable minimize shut-downs and have as low a profile as possible.

Thus it is one object of the present invention to provide a integral pump and pail cover having a very low profile.

Yet another object of the present invention is to provide a pump and pail cover arrangement which is compact in design and easy to use.

Another object is to have dual reciprocal low profile pail mounted pumps which will keep pumping if one of the reciprocal pumps fail.

Still another object of the present invention is to provide a pump and pail cover arrangement which is integral in design and easy to mount on a pail.

Still another object of the invention is to provide a pump and pail cover arrangement which is very portable and easily carried to hard to reach jobs and areas.

BRIEF DESCRIPTION OF THE INVENTION

The purpose of the present invention is to provide a pail mounted pump having a pail cover which provides a low profile to prevent tipping of the pail. Further, the pail cover is constructed with intake tubes a return tube and a skirt which will fit around the periphery of the pail.

The purposes of the present invention are achieved by forming a skirt and a pail cover which will fit over a pail and can be secured. Beneath the skirt is a flange having a annulus to fit snugly around the rim of the pail to seal and minimize spilling of fluids in the pail and stabilize the pump and pail cover. Threaded apertures in the skirt receive thumb screws to firmly secure the pail cover and pump to the pail. Additionally, the thumb screws allow the pump and pail cover to be easily and conveniently removed and transported to another pail.

The pail cover is constructed with a recess for receiving the pump housing to maintain the pump and pail cover to provide very low profile. Additionally, the pail cover receives a return tube diverted from a manifold on the pumping system which allows fluid to be recirculated back to the pail from the pump. A return tube extension is connected to the aperture to return recirculated fluid to the bottom of the pail thereby preventing air from entering the system and agitating fluid at the bottom of the pail to keep the fluid well mixed.

These and other objects of the invention will become apparent from the following detailed description and the detailed drawings in which.

DETAILED DESCRIPTION OF THE INVENTION

Figure 1:
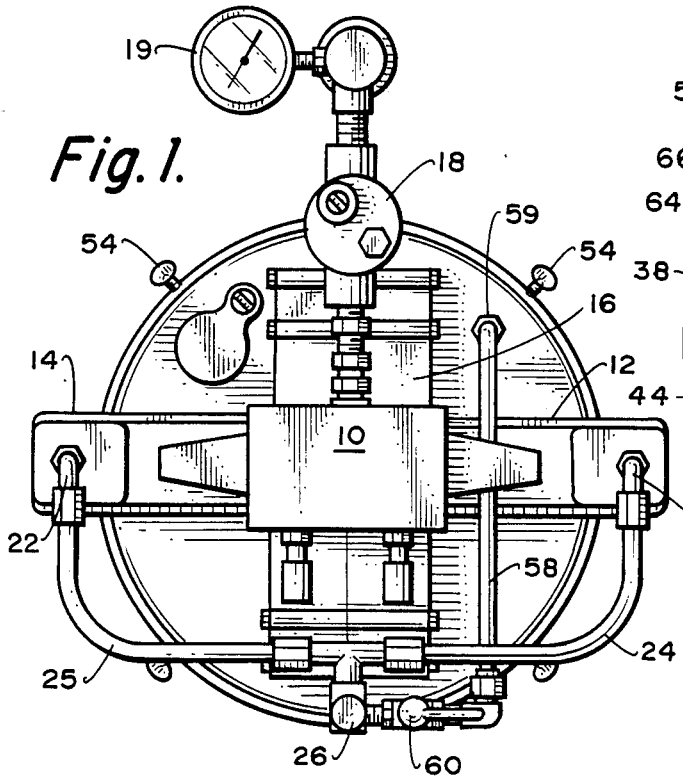
FIG. 1 is a top view of a pump and pail cover assembly.
Figure 3:
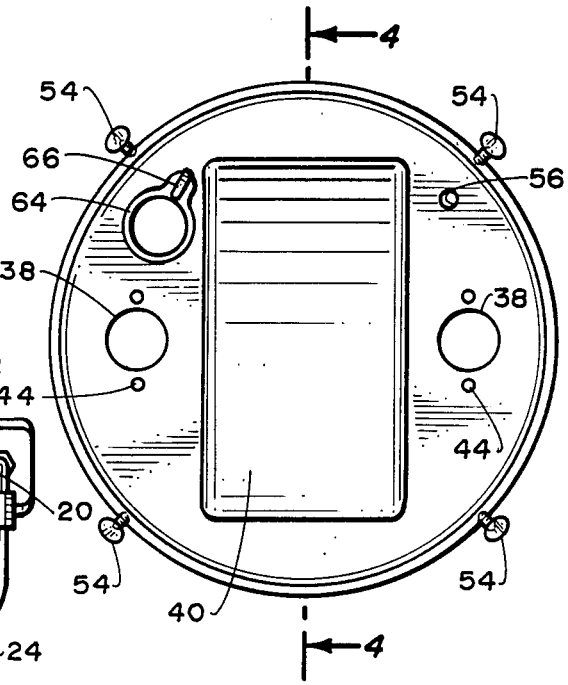
FIG. 3 is a top elevation of the pail cover with the pump removed.

This invention is for use with pumps such as that disclosed and described in U.S. Pat. No. 4,516,725 and the patents cited therein. The pump is constructed to be very efficient and pump effectively, a variety of high viscosity and abrasive fluids. Referring to FIG. 1, pump 10 is comprised of a pair of alternating reciprocal pumps 12 and 14, driven by a double acting reciprocal air motor 16. Air motor 16 is driven by an adjustable valve 18 from a source (not shown) which is regulated by pressure gauge 19. Outlets 20 and 22 of alternating reciprocal pumps connect to manifold 24, 25 for delivery to quick connect/disconnect hose fitting 26. The quick connect fitting is normally closed when no hose is connected. This fitting allows the pumping system to be easily and quickly connected to a delivery system (not shown) such as a spray head or gun.

The pumps 12, 14 draw fluid from pail or container 28 through intake or pickup tubes 30 and 32 which alternately draw the fluid and deliver it through manifold 24, 25 to fitting 26. The dual alternately reciprocal pumps have an added advantage over prior pail mounted pumps in that one pump will continue to deliver fluid should the other stop pumping. This provides the distinct advantage of two pumps for the same fluid in which one would keep pumping should the other fail.

Figure 2:
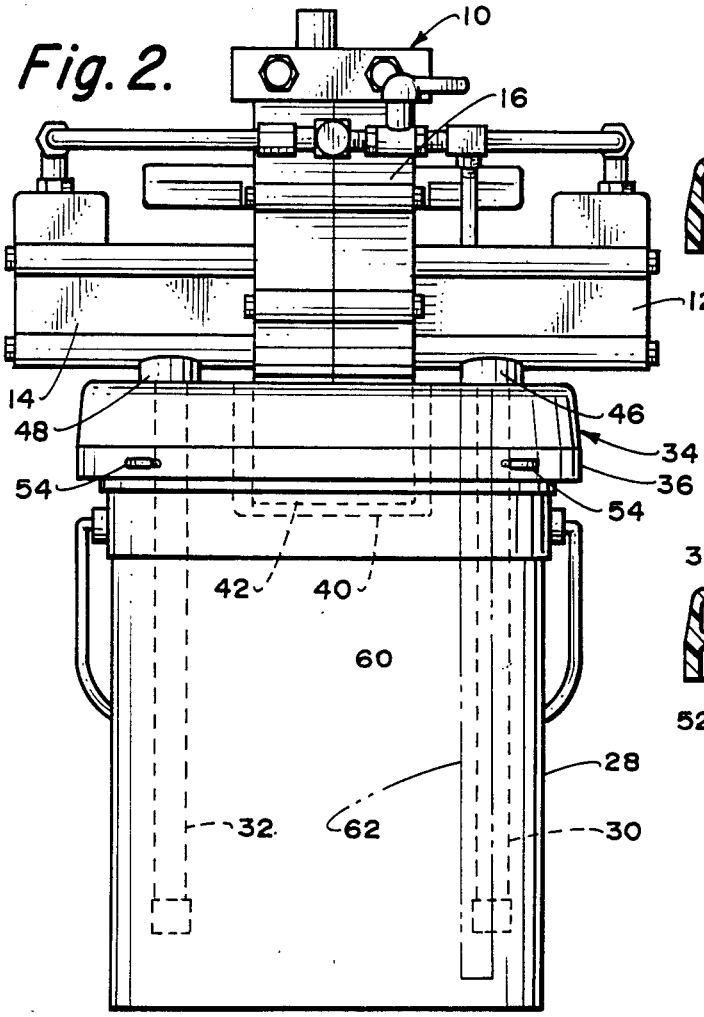
FIG. 2 is a side elevation of the pump and pail cover assembly mounted on a fluid container.
Figure 4:
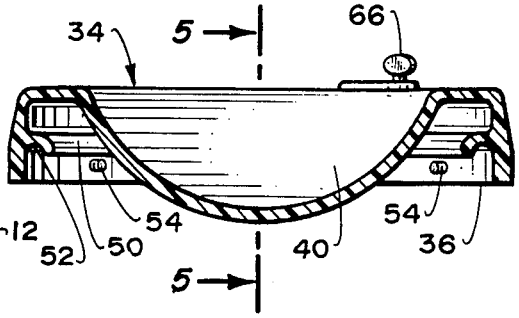
FIG. 4 is a sectional view taken at 4—4 of FIG. 3.
Figure 5:
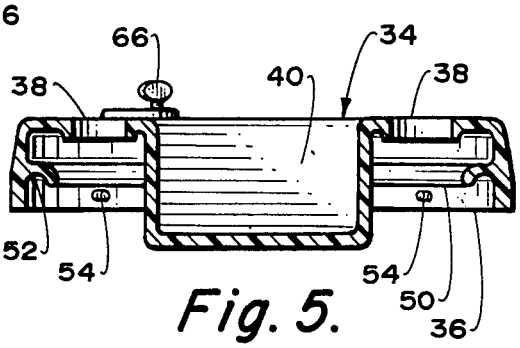
FIG. 5 is a sectional view taken at 5—5 of FIG. 4.

Pail cover 34 is formed to securely mount on the pail 28 and is designed to be integral with pump 10. The cover 34 has a skirt 36, mounting holes 38 for securing the pump, and a well or recess 40 for receiving the air motor housing at 42 (FIG. 2). The pump 10 is secured to pail cover 34 by bolting through bolt holes 44 into bosses 46 and 48 mounting intake tubes 30 and 32 on the pumping system.

Skirt 36 has a circumferential flange 50 on its interior surface forming an annulus 52 which seats on the rim of pail 28 with thumb screws or wing nuts 54 adjustably mounted in threaded holes. The integral pump and pail cover assembly is mounted by seating the rim of pail 28 in annulus 52 and tightening thumb screws 54 tightly against the outside surface of the pail.

A recirculation and agitation mode is provided by recirculating hose 58 secured to hole 56 in the cover by lock nut 59. Valve 60 opens and closes flow from coupling 26 and manifold 24, 25 to hose 58 diverting flow back to the pail 58 diverting flow back to the pail for continuous recirculation.

During spraying operations when the delivery system is temporarily off the fluid is kept agitated and recirculated by opening valve 60 allowing continuous flow of fluid through the pump back to the pail to keep the paint or other fluid fully mixed. As an alternative, a return pipe 62 (FIG. 2) could be provided to be sure fluid return is beneath the surface of the fluid in the pail. This prevents air from entering the system. It also assures that material at the bottom of the pail will be stirred to prevent it from thickening. Lid 64 is secured by a thumb screw 66 covers a port in pail cover 34 permitting the user to view the fluid contents in pail 28 or to act as a vent.

Thus there has been described a unique pump system and pail cover assembly for use on paint pails or the like which provides an integral compact assembly which is both stable and low in profile when mounted on a pail. The system provides the added features of a recirculating system to keep the fluid in the pail constantly recirculating or agitating when the system is not in use. The pump system when mounted on the pail is very portable, easy to carry and ideal for hard to reach jobs.

This invention is not to be limited by the embodiment shown in the drawings and described in the description which is shown by way of example and not of limitation but only in accordance with the scope of the appended claims.

What is claimed:

1. A portable pail mounted pumping system comprising;

a pail cover having a skirt constructed to fit around the peripheral rim of a pail;

flange means beneath said skirt forming an annulus constructed to snugly fit the rim of said pail to stabilize a pumping system mounted on said pail cover;

pump mounting means on said pail cover, said pump mounting means including a recess in said cover constructed to extend below the rim of said pail;

pump means comprised of a pair of alternating reciprocal pumps driven by an air motor mounted on said pail cover pump mounting means, a portion of the housing of said pump means fitting into said recess in said pail cover so that when said pump means and pail cover are mounted on a pail a low profile and center of gravity is provided to prevent the pail from tipping;

fastening means for fastening said pail cover with said pump on the rim of a pail, said fastening means being constructed to allow said pump and pail cover to be easily removed and re-mounted on another pail whereby said pail mounted pump system is easily removed and transported from one pail to another.

2. The portable pail mounted pumping system according to claim 1 in which said pump mounting means on said pail cover comprises a pair of bosses on a pair of apertures in said pail cover;

a pair of intake tubes secured beneath said apertures and extending to near the bottom of a pail when said pump means and pail cover are mounted on a pail;

said pump means being bolted to said pair of bosses with inlets to said pump means in communication with said intake tubes.

3. The portable pail mounted pumping system according to claim 2 in which said pump means is constructed and arranged so that one pump can continue to pump should the other of said pumps fail.

4. The portable pail mounted pumping system according to claim 1 in which said pump means includes;

a manifold connecting outlets from said pair of alternating reciprocal pumps to a single outlet;

coupling means for connectng said outlet from said manifold to a fluid delivery system; and a recirculating means for recirculating fluid diverted from said coupling means to said pail;

whereby fluid in said pail may be continuously agitated by fluid from said recirculating means diverted from said coupling means.

5. The system according to claim 4 in which said recirculating means comprises;

a valve connected to said coupling means; and a return tube connecting said valve to an aperture in said pail cover;

whereby when said valve is opened fluid is diverted from said coupling and continuously recirculated to said pail to keep said fluid agitated.

6. The portable pail mounted pumping system according to claim 5 in which said return tube extends through said aperture in said pail cover to near the bottom of a pair when said pump and pail cover are mounted on a pail whereby fluid returned to said pail continuously agitates fluid at the bottom of said pail.

7. The pail according to claim 6 including a viewing/-venting port in said pail cover; and a pivotal lid secured over said viewing/venting port.

8. The portable pail mounted pumping system according to claim 1 in which said fastening means comprises;

a plurality of threaded aperatures in said skirt beneath said annulus;

and a thumb screw threaded into each of said plurality of threaded apertures adapted to be tightened against the exterior surface of a pail when said pump and pail cover are resting on the rim of a pail.

* * * * *